United States Patent [19]

Noro et al.

[11] Patent Number: 4,842,678

[45] Date of Patent: Jun. 27, 1989

[54] POLISHING CLOTH AND METHOD

[75] Inventors: Shoji Noro, Iruma; Shigemi Mukaiyama, Suzuka, both of Japan

[73] Assignee: Asahi Kasei Kogyo Kabushiki Kaisha, Osaka, Japan

[21] Appl. No.: 193,730

[22] Filed: May 13, 1988

[30] Foreign Application Priority Data

May 15, 1987 [JP] Japan ..... 62-118685

[51] Int. Cl.[4] ..... H01L 21/306; B44C 1/22; C03C 15/00; C23F 1/00

[52] U.S. Cl. ..... 156/636; 156/637; 156/662; 156/903; 156/345

[58] Field of Search ..... 156/345, 636, 637, 639, 156/662, 663, 664, 903; 51/316, 295, 296, 298; 428/304.4, 314.2, 315.5

[56] References Cited

U.S. PATENT DOCUMENTS 4,600,469 7/1986 Fusco et al. ..... 156/636

4,645,561 2/1987 Rea ..... 156/636

*Primary Examiner*—William A. Powell

*Attorney, Agent, or Firm*—Birch, Stewart, Kolasch & Birch

[57] ABSTRACT

The present invention relates to a polishing cloth comprising an expanded thermoplastic resin product having a cellular structure, and an expansion ratio of 1.5-fold to 30-fold, with substantially uniform cells having an average cell diameter of 300 μm or less being distributed within the cross-section of the expanded product, and with unexpanded resin phases of 0.5 μm to 45 μm surrounded by three or more cells, wherein the proportion of the unexpanded phases are 0.01% to 70% in terms of area ratio within the expanded product cross-section, which has excellent performance of mirror surface polishing, for example, integrated circuit substrate, disc substrate for information recording, optical lens, optical mirror, etc. The present invention particularly relates to a polishing cloth for precise polishing to a surface roughness of 100 Å or less.

17 Claims, 1 Drawing Sheet

10 μm

10 μm

POLISHING CLOTH AND METHOD

BACKGROUND OF THE INVENTION

1. Field of the Invention

The present invention relates to a polishing cloth for precise polishing. More particularly, the present invention relates to a polishing cloth for precise polishing having excellent polishing characteristics for mirror surface finishing. The polishing cloth of the present invention is to be used for the polishing of integrated circuit substrates such as silicon monocrystalline wafer, compound semiconductor wafer, etc.; disc substrates for information recording such as aluminum disc, glass disc, etc.; solar battery substrates such as silicon polycrystal, silicon monocrystal, compound semiconductor, etc.; optical parts such as cathode-ray tube, optical lens, optical mirror, optical prism, optical isolator, optical switch, etc.; mask blanks to be used in the manufacture of integrated circuit devices; substrates for liquid crystal display devices, magnetic heads and other precise parts.

2. Related Prior Art

In recent years, in addition to the reduction of circuit line width and the higher densification accompanied with the higher integration of an integrated circuit, the enlargement of the aperture of a silicon wafer to be used has progressed to the point, whereby demands for finishing precision of precise working such as roughness of wafer surface and parallel degree, which become the problems during circuit formation, are becoming increasingly severe.

A compound semiconductor as represented by GaAs, when compared with silicon monocrystal, is more likely to be damaged during working finishing and accordingly it is difficult to enhance working precision such as surface roughness, parallel degree, etc. Thus, more delicate care and contrivance is required in the case of the compound semiconductor than in the case of the silicon monocrystal.

Along with such severe demands for the worked product, an improvement of precision for machines and tools used for precise working have also been demanded. Particularly, an improvement of working precision on the atomic order is now demanded for polishing working in the final finishing step. In the prior art, as the polishing cloths to be used for such polishing working, there have been proposed polishing cloths prepared by the formation of grooves for supplying polishing liquid and discharging polishing dust onto flattened pitch or wax. Polishing cloths having polyurethane impregnated onto polyester base cloths; polishing cloths having polyurethane impregnated onto polyester base cloths, followed by foaming; or polishing cloths having a polyurethane expanded layer laminated on polyester base cloths, etc., also form part of the product. Of those mentioned, the polishing cloths having the polyurethane expanded layer are becoming the ones which are mainly used. Also, polishing cloths with the cell shape of the polyurethane expanded layer being made a specific shape, have been developed. For example, Japanese Patent Publication No. 45918/1977 discloses a polishing cloth having vertically shaped voids with a lateral cross-section which is in parallel to the polishing cloth surface, and is ellipsoidal wherein the shape of the lateral cross-section being substantially unchanged in the thickness direction.

A polishing cloth comprising a polyurethane expanded layer impregnated or laminated onto a polyester base cloth has such problems as (1) a variance in the degree of denseness corresponding to the texture of the base cloth, (2) insufficient smoothness, nonuniformity of hardness and nonuniformity of friction due to the variance in cell size, poor distribution on the base cloth side of the expanded layer, (3) poor durability of polishing due to the material and also nonuniform distribution of the cells in the expanded layer, (4) deterioration of the polishing cloth due to the etching action of a polishing liquid has been used for the polishing of a compound semiconductor wafer, whereby the surface roughness and smoothness of the polishing cloth are remarkably lowered and the surface precision of the worked product is worsened. On the other hand, when a polishing cloth having cylindrical voids, as disclosed in Japanese Patent Publication No. 45918/1977 is used, polishing liquid, abrasive particles, and the like, will be caused to reside in the cylinder, whereby the composition thereof, particularly of the polishing liquid, is changed with the lapse of time which gives rise to nonuniformity in the chemical action onto the surface to be polished when the polishing cloth is used. Also, with the lapse of time the abrasive particles which has been caused to reside therein become accumulated which causes changes in the physical properties of the polishing cloth such as elasticity, hardness, frictional coefficient, etc., which in turn further gives rise to nonuniformity, as well as changes in the mechanical polishing action, whereby with these problems, the polishing performance could not be stabilized and that the quality of the article to be polished becomes worsened when being subjected to being polished.

SUMMARY OF THE INVENTION

The present inventors have intensively studied the above described problems in order to solve these problems, and consequently found that an expanded thermoplastic resin product having a cellular structure, and an expansion ratio of 1.5-fold to 30-fold, with substantially uniform cells having an average diameter of 300 μm or less being distributed within the cross-section of the expanded product and with unexpanded resin phases of 0.5 μm to 45 μm surrounded by 3 or more cells, wherein the proportion of the unexpanded phases are 0.01% to 70% in terms of area ratio within the expanded product cross-section, exhibits excellent polishing characteristics, to accomplish the present invention. A product so characterized, has not been found in the prior art.

Thus, the present invention relates to a polishing cloth comprising an expanded product thermoplastic resin product having a cellular structure, and an expansion ratio of 1.5-fold to 30-fold, with substantially uniform cells having an average cell diameter of 300 μm or less being distributed within the cross-section of the expanded product, and with unexpanded resin phases of 0.5 μm to 45 μm surrounded by three or more cells, wherein the proportion of the unexpanded phases are 0.01% to 70% in terms of area ratio within the expanded product cross-section.

DETAILED DESCRIPTION OF THE INVENTION

Figure 1:
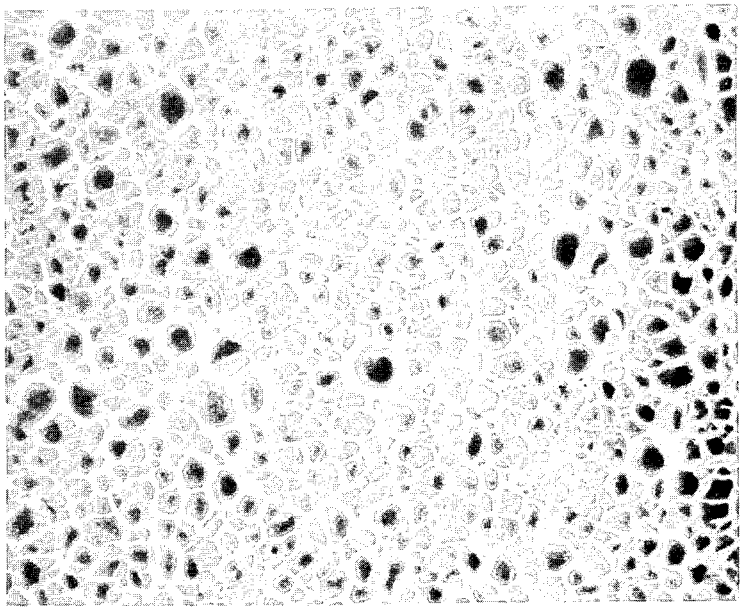
FIG. 1 and FIG. 2 are electron microscope photographs, each showing the cellular structure of the cross-section of the expanded product obtained in Examples 1 and 2, respectively, in which A represents cells and B represents unexpanded resin phase surrounded by cells.
Figure 2:
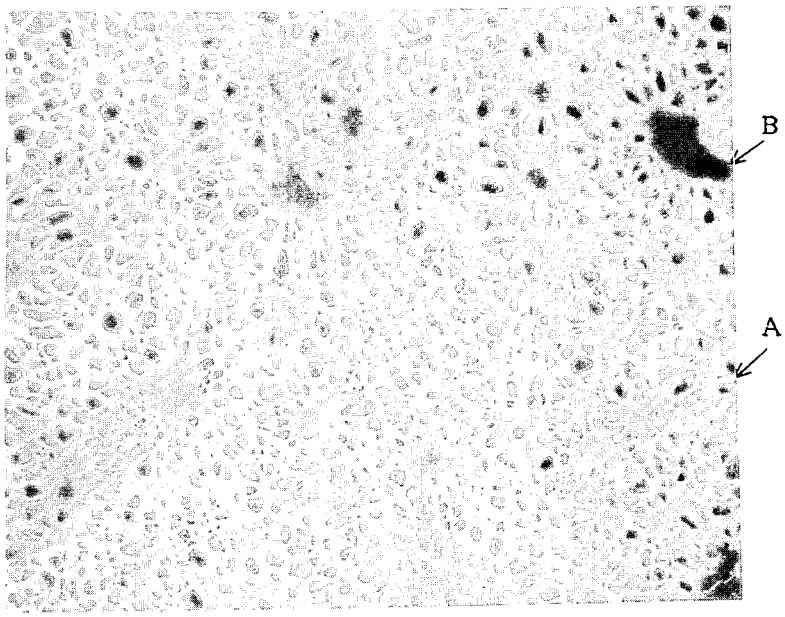

The expanded thermoplastic resin product of the present invention has an expansion ratio of 1.5-fold to 30-fold. An expanded thermoplastic resin product having an expansion ratio of less than 1.5-fold is hard, and therefore such a product is not sufficiently relaxed when being used in a scratch-removing action or a frictional action with the worked product. The primary task of a polishing cloth, is to be relaxed during the physical action between the abrasive particles and the worked product surface when using a polishing cloths having abrasive particles in order to have an averaging effect, whereby working damages such as fine cracks, crazings, scratches etc., or defect such as orange peel, etc., are generated. On the other hand, a highly expanded product with an expansion ratio exceeding 30-fold would be contrariwise too soft, and the elastic deformation constant (amount of deformation under a constant load) of the polishing cloth would be too great, whereby the flatness at the working surface would be lowered which would cause remarkable lowering in the working speed due to the remarkable lowering in the scratch-removing action or the frictional action and also the mechanical strength would become lowered, which would worsen the durability.

The expanded product of the present invention has an average cell diameter of 300 μm or less. If the average cell diameter is larger than 300 μm, the surface smoothness of the polishing cloth is worsened, which would worsen surface roughness, undulation, etc., of the worked product. Also, frictional, scratching action at the cell membrane cross-section would become too great, whereby a localization of abrasive particles would occur when using abrasive particles and defects such as scratch damages, orange peel, etc., are likely to occur on the worked surface.

For well-balanced polishing finish precision of the worked surface, uniformity of quality, polishing speed, etc., an expanded product having an expansion ratio of 1.5-fold to 15-fold and an average cell diamater of 1 μm to 90 μm is preferable.

The cells in the expanded thermoplastic resin product of the present invention may generally be formed in the shape of a sphere, a, football, a cylinder or (a) polygonal body having these shapes, etc., and these shapes may be selected depending on the type of worked product to be polished, the type of the polishing liquid, the method and the conditions of polishing, etc. The cells in the expanded product of the present invention are uniform in size and shape. For example, a cell having no large macrovoids with a size larger by 3-fold than the average cell diameter dispersed in the expanded product is preferred. As to shapes, it is preferred that no cell or macrovoid would have a shape which is different from the above described shapes, such different shapes being, e.g., cylindrical or pear-like shapes which would be co-existing with cells comprising substantially spherical polygonal bodies. In this connection, as an exceptional case for a purpose other than polishing, such as adhesion of the polishing cloth to the fixed plate of a polishing machine, the cells at the surface layer portion of the back surface of the expanded sheet may be made larger than the cells at the front surface which is the polishing surface and the central part of the expanded product.

The expanded thermoplastic resin product of the present invention has a cellular structure, with substantially uniform cells being distributed within the cross-section of the expanded product, and has an unexpanded resin phase of 0.5 μm to 45 μm surrounded by 3 or more cells, wherein the proportion of the unexpanded phases are 0.01% to 70% in terms of area ratio within the expanded product cross-section. By "substantially uniform cells being distributed within the cross-section of the expanded product" it is meant that there are no macrovoids exceeding 5-fold of the average cell diameter. An example, would be a situation in which only cells with sizes of 3-fold to ⅓-fold of the average cell diamater would be existing within the cross-section of the expanded product. If voids exceeding 5-fold of the average diameter exist within the cross-section of the expanded product, a lowering in surface roughness of the worked product may be caused, or abrasive particles or polishing dust may be localized to cause formation of scratching damages on the surface of the worked product. The unexpanded resin phase of 0.5 μm to 45 μm surrounded by 3 or more cells is formed at the bonded portion of the cells during the expansion process and its sizes and distribution are determined depending on the size of the cells, the expansion ratio, the distribution density of the cell nuclei and the time difference in the Commencement of expansion between cell nuclei, etc. If the size becomes larger, e.g., as exceeding 45 μm, scratching damages may be formed on the worked product, or the difference in elastic deformation constant at this portion may lower the plane precision of the worked product surface. The proportion of the unexpanded resin phases are 0.01% to 70% in terms of area ratio within the expanded product cross-section. If it is more than 70%, the properties of elasticity, strain absorbing ability, polishing ability with the cell cross-section, etc. of an expanded thermoplastic resin product will be lowered, and thus would not accomplish the object of the present invention. On the other hand, if it is less than 0.01%, the shape of the cells during polishing may be deformed, or the cell membrane is likely to be broken, thus lowering the durability of the polishing cloth. An expanded thermoplastic resin product with unexpanded resin phases, wherein the proportions thereof ranging from 0.01% to 10%, in terms of area ratio within the expanded product cross-section, is preferred, because this would characterize the product with well-balanced polishing characteristics, such as small roughness, and small undulation of the worked product, without defects such as scratching damage, orange peel, etc., and also would characterize the product with high polishing speed.

The expanded thermoplastic resin product of the present invention is an expanded product produced by homogeneously mixing a thermoplastic resin or a mixture of two or more thermoplastic resins selected from, including polyolefins such as polyethylene, polypropylene, polybutene, poly-4-methyl-1-pentene, etc.; copolymers and ionomer resins comprising an olefin as the main component such as ethylene-vinyl acetate copolymer, ethylene-acrylic acid copolymer; thermoplastic fluoro-resins such as polyvinyl fluoride, polyvinylidene fluoride, ethylene/tetrafluoroethylene copolymer, propylene/tetrafluoroethylene copolymer, ethylene/-chlorotrifluoroethylene copolymer, vinylidene fluoride/hexafluoropropylene copolymer, vinylidene fluoride/tetrafluoroethylene copolymer, vinylidene fluoride/trifluoroethylene copolymer, vinylidene fluoride/-tetrafuoro-ethylene/hexafluoropropylene copolymer, polychlorotetrafloro-ethylene, tetrafluoroethylene/- hexafluoropropylene copolymer, tetrafluoroethylene/-perfluoroalkyl vinyl ether copolymer, tetrafluoroethylene/hexafluoropropylene/perfluoroalkyl vinyl ether, etc. with a chemical blowing agent, a physical blowing agent or an inert gas, followed by expansion. As the production process, those described in, for example, C. J. Benning, "Plastic Foams" may be available. Also, the process for producing an expanded product or a porous product according to the gel-solution phase separation from a polymeric solution (e.g. J. Cellular Plastics, Vol. 23, p. 55) can be used. The expanded product of the present invention can use either an uncrosslinked expanded thermoplastic resin product or a crosslinked expanded thermoplastic resin product. Of the two, the crosslinked expanded product is preferred because of having an excellent durability to deformation by heat generation during polishing, to deformation by frictional force, to deterioration with polishing liquid, etc.

The degree of crosslinking may be preferably in the range of 0.3 to 0.9 in terms of tan $\delta$ (dynamic shear loss modulus/dynamic shear storage modulus ratio, value measured at an angular frequency of 10 radian/sec., a strain amount of 5%) at a temperature higher by 30° C. than the melting point of the resin (the melting peak temperatue by DSC), because the cells are uniform without voids, the coarseness of the surface, etc. and also uniformity of the expansion ratio are excellent.

The expanded product of the present invention may preferably be obtained by the expansion of one or a mixture of two or more thermoplastic resin selected from polyethylene, polypropylene, polybutene, poly-4-methyl-1-pentene, ethylene/tetrafluoroethylene copolymer, vinylidene fluoride/hexafluoropropylene copolymer, vinylidene fluoride/tetrafluoroethylene copolymer, vinylidene fluoride/trifluoroethylene copolymer, vinylidene fluoride/hexafluoro-propylene/tetrafluoroethylene copolymer, polyvinylidene fluoride, whereby the expansion ratio and the average cell diameter can be varied in wide ranges and an expanded product of stable quality can be obtained, and also the properties of durability and polishing liquid resistance of the polishing cloth are excellent. More preferably, the expanded thermoplastic resin product of the present invention may be obtained by crosslinking the above thermoplastic resin by a chemical crosslinking agent or by ionizable radiation such as irradiation with $\gamma$-ray, electron beam, etc. and expanding the crosslinked resin. The crosslinking may also be effected by introducing crosslinkable functional groups into the resin, and further crosslinking may be effected by adding a crosslinking aid such as divinylbenzene, triallylisocyanurate, triallylcyanurate, etc. The expansion method is not particularly limited, but because of absence of contamination onto the worked product when used as the polishing cloth, it is particularly preferable to use one of the following methods or combinations thereof. The method in which one or a mixture of two or more selected from physical blowing agents, which include halogenated hydrocarbons such as dichlorodifluoromethane, trichlorofluoromethane, dichloro-fluoromethane, trichlorotrifluoroethane, dichlorotetrafluoroethane, tetrafluoroethane, dichlorotrifluoroethane, etc., hydrocarbons such as propane, butane, pentane, etc., is kneaded at high temperature under pressurization and expanded by extrusion. The method in which the blowing agent is impregnated into the particles or the sheet of the thermoplastic resin and expanded by in-mold expansion or atmospheric expansion, or the method in which the thermoplastic resin shaped in a sheet is crosslinked by irradiation of electron beam, etc. and impregnated with a blowing agent, followed by heating expansion.

The polishing cloth of the present invention can be prepared by working the expanded thermoplastic resin product as described above by cut-off, slicing, skiving, grinding, cutting, tearing, etc., into a desired shape such as a tape, a sheet, a buff, etc., and one having a skin layer on its surface or one having the cell cross-section exposed thereon may be used. The shape and the surface state of the polishing cloth may be selected suitably depending on the type and shape of the worked product to be polished, the polishing purpose, the polishing method, etc. One having the cell cross-section exposed on its surface is preferred because of having excellent well-balanced properties such as frictional coefficient of the polishing cloth, dispersibility of polishing liquid and abrasive particles, scratching effect of the worked product surface, etc. For example, in the case of polishing a wafer substrate for an integrated circuit substrate, a sheet with a thickness of 0.1 to 2 mm is used, and one having the cell cross-section exposed on its surface with the undulation at the outermost surface of the cell cross-section of 50 $\mu$m or less per measured length of 2 mm is used. Since the smoothness of the surface of the polishing cloth affects surface roughness, undulation, etc., of the worked product, it is important to control the smoothness precisely when effecting highly precise polishing, and the undulation at the outermost surface of the polishing cloth surface of 25 m or less per 2 mm is preferable.

The polishing cloth of the present invention can be used as a sheet, as such, with its surface being flat. However, depending on the polishing method and the size of the worked product, a polishing cloth with grooves of 0.1 to 2 mm of width, and 0.1 to 2 mm of depth formed regularly in a lattice, a diaper or a satin pattern at intervals of 1 to 50 mm may be employed. Such grooves are effective for supplying and discharging of polishing liquid, and grooves with rounded edges relative to the polishing cloth surface are preferable, because polishing with high precision can be accomplished without causing local scratching, friction, etc., of the worked product.

The polishing cloth of the present invention can either be used alone or it can alternatively be formed into a composite with the application of an expanded product with a different expansion ratio or cell size on the back surface or the front surface thereof depending on the purpose. Also, a reinforcing material, cushioning layer or rigidity imparting layer comprising another material may also be bonded to the polishing cloth. In either case of such single or combined use, the surface hardness of the polishing cloth is generally 90 to 30 (JIS Method A).

The polishing cloth of the present invention may be used for polishing working of various worked products, but it is particularly suitable for mirror surface polishing working. Although various methods may be employed depending on the properties of the worked product, mechanochemical polishing or chemical polishing is preferred in that the characteristics of the expanded thermoplastic resin product of the present invention can be fully exhibited. These polishing methods are described in, for example, Akira Kobayashi, Ed. "Ultra-precise Working Technique Practical Manual" (published by New Technology Development Center, 1985), p.58–81. As the polishing liquid, there may be employed, for example, an aqueous medium, an aqueous alkaline solution, an aqueous oxidiaing agent solution, etc., each having polishing abrasive particles dispersed therein. Acidic aqueous solution, alkaline aqueous solution, organic solvent such as Br-methanol, etc., are capable of dissolving the worked product. Particularly, because of having excellent chemical resistance and durability to the inorganic or organic alkali, acid or oxidizing agent solution and having the capability of converting the worked product to a compound which will readily dissolve or be eliminated by dissolution or reaction, these polishing liquids are excellent for the ultra-precise polishing method of silicon wafer, compound semiconductor wafer, GGG (gadlinium, galium, garnet) substrate, Mn-Zn ferrite, etc. By the use of these polishing liquids, polishing to surface roughness of 100Å or less, even to 10Å or less is possible.

[EXAMPLES]

The present invention is described in mor detail by referring to the following Examples, and various characteristics in the present invention are determined according to the methods as described below.

(1) Expansion ratio:

The density of the expanded thermoplastic resin product is measured and the expansion ratio is calculated from the following formula:

$$\text{Expansion ratio} = \frac{\text{Resin density}}{\text{Expanded product density}}$$

(2) Cell size and uniformity of cells:

The cell as defined in the present invention consists of the cell (gaseous portion) in the expanded product and the cell membrane (resin membrane) surrounding therearound. The cell diameter is determined by drawing a straight line of any constant length (across 10 or more cells) on an enlarged photograph of the cross-section of the expanded product by an electron microscope (SEM) or an optical microscope, counting the number of the cells thereacross and calculating the length per cell. The cell diameters are determined at 3 places or more in the respective directions of the thickness, the length and the width of the expanded product, and the average value of all of these is determined as the average cell size. Also, a transverse cross-sectional view vertical to the surface of the polishing cloth is enlarged according to the same method as above, photographed so that the expanded product layer, namely the whole of the layers participating substantially in polishing may come within the field of view, and the presence or absence of macrovoids greater by 3-fold or more than the average cell diameter, as well as the presence or absence of cells or macrovoids apparently different in shape from the main cells of the expanded product such as cylindrcal or pear-like shapes are observed with the eyes. The product in which no such macrovoid, abnormally shaped cell is substantially detected in the mass of cells which constitute the expanded product is evaluated as one having substantially uniform cells distributed therein.

(3) Size and ratio of unexpanded resin phases:

In the photographs of the 10 places randomly selected of the cross-section of the expanded product with enlargement by an electron microscope or an optical microscope, the maximum dimension of the unexpanded resin phases surrounded by 3 or more cells are measured and defined as being their size. The areas of the resin phase portions are determined, the sum thereof is calculated and the percentage relative to the total area (namely, the photographic field of area) is defined as the ratio of the resin phases.

(4) Smoothness of the surface of the expanded product:

The surface of the polishing cloth cut in the vertical direction to the polishing surface is enlarged to 50-fold or more, straight lines of 2 mm in length as the real dimension are contacted along the polishing surfaces of any desired 5 places, the maximum distances between the straight line and the outermost surface of the polishing surface (the hypothetical surface connecting the cell membrane cut points of the cell cross-section) are measured, and the average value is defined as the undulation.

(5) Chemical resistance:

A sample is dipped in 2% Br-methanol solution heated to 75° C. for 90 hours at the maximum and thereafter tensile test is conducted. Elongation at break of the sample is measured, and the sample with retentivity of 90% or more relative to the original elongation is evaluated as usable and the sample with retentivity less than 90% as unusable. Decoloration, dimensional change, breaking of cell membrane, etc. of the sample are also observed, and those with remarkable decoloration, dimensional change of 5% or more and occurrence of breaking of cell membrane are evaluated as unusable.

(6) Polishing characteristic:

A GaAs monocrystalline wafer subjected to lapping by the use of alumina abrasive particles with an average particle size of 5 μm as the pre-working is polished by means of a polishing device as described in J. Electrochem. Soc., Vol. 118, No. 8, P. 1346 (called Device 1) and a polishing device disclosed in Japanese Laid-open Patent Publication No. 61764/1986 (called Device 2). The polishing conditions in the case of Device 1 are polishing cloth size of 300 mm in diameter, polishing cloth plate rotational number of 120 r.p.m., polishing pressure of 80 g/cm$^2$, polishing liquid of 2% Br-methanol solution, polishing liquid feeding rate of 10 cc/min., and after polishing for 60 minutes, the surface roughness, undulation, etc. of the worked product are measured by the feeler type surface roughness measuring instrument produced by Rank-Tellor-Hobson Co., and also the polishing speed (μm/hr) determined from the thickness change of the worked product. On the other hand, in the case of the Device 2, 0.25% Br-methanol solution (mixed solvents of 80% methanol and 20% ethylene glycol) is used as the polishing liquid, and with the GaAs monocrystal being fixed on a polishing implement capable of controlling contact between the surface of the worked product and the surface of the polishing cloth, polishing is effected while controlling the contact state every 30 seconds, and the surface roughness of the worked product is measured. Also, the appearance of the surface of the worked product is evaluated according to the method described in the SEMI standard, and the presence or absence of defects such as orange peel, etc., are evaluated.

EXAMPLE 1

A vinylidene fluoride/hexafluoropropylene copolymer (trade name: Kainer 2800, produced by Penwalt Co.) is fed into an extruder to be molded into a sheet with a thickness of 1.1 mm, which is then crosslinked by irradiation with an electron beam corresponding to an absorption dosage of 20 Mrad by means of an electron beam irradiating device with an acceleration voltage of 500 kV (produced by Nisshin Highvolage Co.). The crosslinked sheet is placed in an autoclave, and the autoclave is pressurized by dichlorodifluoromethane and impregnation effected at 75° C. for 100 hours, to give an expandable sheet containing 0.65 mol of dichlorodifluoromethane per one liter of the resin. The expandable sheet is heated with steam of 3.0 kg/cm$^2$ gauge pressure for 30 seconds to obtain an expanded sheet with a thicknes of about 3 mm. The expanded product was found to be an extremely flexible expanded product with an expansion ratio of 5-fold, having substantially uniform cells, with an average cell size of 12 μm and 0.01% of the unexpanded resin phases with sizes of 0.5 μm or more.

The expanded sheet is sliced at both surfaces by a slicer (AV-320-D model, produced by Fortuner Co., West Germany) into sheets with a thickness of 1 mm and a surface smoothness of 20 μm. The slice sheet with the cell cross-section exposed is punched out into a disc of 300 mm in diameter to provide a polishing cloth. The polishing cloth is plastered on the fixed plate of the polishing device (Device 1), and the polishing performance and the chemical resistance of the cloth are evaluated.

The polishing cloth comprising the expanded sheet is found to have excellent chemical resistance, and is excellent in polishing performance. The polishing cloth is also capable of ultra-precise polishing a GaAs wafer to Rmax 15 Å and the maximum undulation of 95Å. The polishing speed at this time was 32 μm/hr

EXAMPLES 2 and 3

The expandable sheet obtained in Example 1 is expanded according to the same method as in Example 1 except for using the expansion conditions of a steam pressure of 2.3 kg/cm$^2$ and a heating time of 15 sec. and 10 sec., respectively, to obtain the expanded sheets. The expanded products has substantially uniform cells, and properties as shown in Table 1. The expanded products obtained are sliced in the same manner as in Example 1 and the polishing performances are evaluated to obtain the results shown in Table 1.

The surfaces of the worked products are extremely excellent with a surface roughness (Rmax) of 20Å or less, with the maximum undulation being also 100 Å or less, without defects such as scratch, orange peel, etc.

COMPARATIVEE EXAMPLE 1

The expandable sheet obtained in Example 1 is heated under a steam pressure of 2.1 kg/cm$^2$ gauge for 10 seconds to obtain an expanded sheet. The expanded sheet has an expansion ratio of 1.3-fold, an average cell diameter of 3 μm, and unexpanded resin phase with a size of 45 μm and an area ratio of 80%. From the result of the polishing test according to the same method as in Example 1, conducted on the expanded sheet, a large number of scratches are formed on the surface of the worked product and the surface roughness is also inferior, as shown in Table 1.

COMPARATIVE EXAMPLE 2

The expandable sheet obtained in Example 1 is heated under a steam pressure of 4.5 kg/cm$^2$ gauge for 20 seconds to obtain an expanded sheet. The results of evaluation of the expanded sheet as the polishing cloth are shown in Table 1. The surface roughness of the worked product is about 20Å , but the undulation became greater with the working precision being inferior. Also, the expanded sheet was susceptible to compression deformation by polishing pressure and friction, whereby polishing under constant conditions cannot be maintained which illustrates the expanded sheet to be inferior in durability.

COMPARATIVE EXAMPLE 3

According to the same method as in Example 1 except for impregnating the crosslinked sheet with dichlorotetrafluoroethane, an expandable sheet is obtained. The expandable sheet obtained is heated with steam of 3.0 kg/cm$^2$ gauge to obtain an expanded sheet. The properties of the expanded sheet obtained are as shown in Table 1. Next, it was worked into a polishing cloth according to the same method as described in Example 1, and its polishing performance is evaluated. The results shown in Table 1, are that scratched damages are generated on the surface of the worked product to give a product of inferior quality.

EXAMPLE 4

The crosslinked sheet obtained in Example 1 is impregnated with a mixed blowing agent of dichlorodifluoromethane/dichlorotetrafluoroethane at a molar ratio of 70/30 to obtain an expandable sheet. The expandable sheet obtained was heated with steam of 3.0 kg/cm$^2$ for 30 seconds to obtain an expanded sheet. The expanded sheet obtained has an expansion ratio of 8-fold, an average cell diameter of 40 μm and an unexpanded resin phase of 0.08%. A polishing cloth with surface smoothness of 25 μm is obtained by slicing according to the same method as in Example 1 and its polishing performance is evaluated. From the result, excellent polishing characteristics are exhibited with a surface roughness of 18Å, and a maximum undulation of 90Å, without surface defect.

COMPARATIVE EXAMPE 4

The expandable sheet obtained in Example 4 is heated with steam of 2.3 kg/cm$^2$ gauge for 10 seconds to obtain an expanded sheet. The expanded sheet obtained has an expansion ratio of 1.5-fold, an average cell diameter of 36 μm and unexpanded resin phase with a size of 45 μm and a ratio of 72%. From the result of evaluation of the expanded sheet as the polishing cloth, a large number of scratches are generated on the surface of the worked product, with the surface roughness also being inferior.

COMPARATIVE EXAMPLE 5

The expandable sheet obtained in Example 4 is heated with steam of 2.6 kg/cm$^2$ gauge for 5 seconds to obtain an expanded sheet. The expanded sheet obtained has an expansion ratio of 1.6-fold, an average cell diameter of 36 μm, and unexpanded resin phase with a size of 150 μm and a ratio of 50%. From the result of evaluation of the expanded sheet as the polishing cloth, the surface roughness and the undulation of the worked product are great, and the quality is inferior with scratches occurring elsewhere.

EXAMPLES 5 and 6

By use of a polyvinylidene fluoride (Kainer 730, produced by Penwalt Co.) and an ethylene-tetrafluoroethylene copolymer (Acron COP C 88APM, produced by Asahi Glass Co.) as the thermoplastic resins, each resin is extrusion molded into a sheet with a thickness of 1.1 mm. The sheets are then crosslinked by irradiation with an electron beam of 30 Mrad, 40 Mrad, respectively, by means of an electron beam irradiating device to obtain crosslinked sheets. The crosslinked sheets obtained are impregnated with dichlorotetrafluoroethane and isopentane, respectively, at 75° C. to obtain expandable sheets. The expandable sheets are subsequently heated with heated oil at 220° C. for 50 sec. and at 290° C. for 40 sec., respectively, to obtain expanded sheets. The expanded sheets obtained have the properties shown in Table 1. From the result of the evaluation of the respective polishing performances according to the same method as in Example 1, both are found to exhibit excellent polishing characteristics.

EXAMPLE 7

A sheet with a thickness of 1 mm extrusion molded by feeding a polypropylene resin (PP-M 7500, produced by Asahi Kasei Kokyo K.K.) into an extrusion molding device is placed in an autoclave, and the autoclave is pressurized by dichlorodifluoromethane to impregnate the sheet at 80° C. for 1 hour, whereby an expandable sheet is obtained. The expandable sheet is heated with steam of 4.0 Kg/cm$^2$G for 15 seconds to obtain an expanded wheet with an expansion ratio of 8-fold and a thickness of 2 mm. The expanded product is sliced at both surfaces to 1 mm thickness by a slicer (AV-320-D, produced by Fortuner Co., West Germany). The average cell diamater at the sliced surface of said expanded sheet is 35 μm, and with the unexpanded resin phase being 0.5%. Said slice sheet was punched out into a circular shape of 300 mm ϕ in diameter to provide a polishing cloth, of which the polishing characteristics are examined by use of Device 2. From the results shown in Table 2, said expanded sheet is found to have high polishing capability without an impairment to the quality of the polished surface of the GaAs wafer.

EXAMPLE 8

After a 4-methyl-l-pentene resin (DX-845, produced by Mitsui Sekiyu Kagaku Kogyo K.K.) is dissolved in durene at 180° C. to prepare a 5% by weight of a polymer solution, the solution is gradually cooled to 140° C. to precipitate an expanded product. Next, durene which is the solvent, is removed at 50° C. under reduced pressure to obtain the desired expanded product. The expanded product has an average cell diameter of 10 μm, an unexpanded resin phase of 0.1% and an expansion ratio of 15-fold. When the polishing cloth performance is examined according to the same method as in Example 7, the results shown in Table 2, illustrate the polishing cloth as having high polishing performance.

EXAMPLE 9

A polyethylene crosslinked expanded sheet obtained by kneading uniformly 9 parts by weight of azobisformamide with a low density polyethylene (MI 1.7), extrusion molding the mixture into a sheet, crosslinking the sheet by electron beam irradiation to a gel content of 70%, followed by expansion by heating at 200° C., is sliced according to the method as in Example 7 to prepare a polishing cloth.

The results of the polishing characteristics of the polishing cloth obtained are shown in Table 2.

EXAMPLE 10

100 Parts by weight of an ionomer resin (Himilan R 1601) together with 0.5 part by weight of talc are fed into an extrusion expanding device, followed by pressurization by 32 parts by weight of dichlorodifluoromethane to be mixed uniformly under high temperature and high pressure, and then the mixture is cooled to 119° C. and permitted to be extruded and expanded through a nozzle equipped with a circular die into the air to obtain an expanded sheet.

The expanded product obtained is a continuous cellular product having an expansion ratio of 28-fold, an average cell diamater of 90 μm and fine pores of 1 to 10 μm in the cell membrane.

The expanded sheet is sliced according to the same method as in Example 1 for examination of the polishing characteristics. The results are shown in Table 2.

EXAMPLE 11

In Example 7, the expandable sheet impregnated with dichlorodifluoromethane is heated with steam of 3.8 Kg/cm$^2$G for 15 seconds to obtain an expanded sheet with an expansion ratio of 4-fold and an average cell diamater of 33 μm.

The expanded sheet is sliced according to the same method as in Example 7 and its polishing characteristics are examined to obtain the results a shown in Table 2.

EXAMPLE 12

A ultra-high molecular weight polyethylene (molecular weight: about 3,000,000) is dissolved in tetralin at 150° C. to produce a solution of 9% by weight. Next, the solution is cooled at a rate of 10° C./min. to precipitate and gel the polymer, followed by removal of the tetralin under reduced pressure to obtain an expanded product. The expanded product is found to have an average cell diameter of 1 μm and an expansion ratio of about 8-fold. The expanded product obtained is sliced in the same manner as in Example 8, and the polishing characteristics are evaluated. The results are shown in Table 2.

EXAMPLE 13

By use of a polyethylene crosslinked expanded sheet with an expansion ratio of 8-fold and an average cell diamater of 90 μm obtained according to the same method as in Example 9 except for using 4 parts by weight of the chemical blowing agent, a polishing cloth is prepared according to the same method as in Example 7, and the polishing characteristics of the polishing cloth are evaluated. The results are shown in Table 2.

COMPARATIVE EXAMPLE 6

A board of an extrusion expanded polyethylene with an expansion ratio of 8-fold and an average cell diamater of 400 μm (Suntecfoam, produced by Asahi Kasei Kogyo K.K.) is sliced and evaluated as the polishing cloth according to the same method as in Example 7. Although the chemical resistance is good, the polishing performance is poor with great surface roughness and undulation of the wafer.

COMPARATIVE EXAMPLE 7

A commercially available crosslinked expanded sheet with an expansion ratio of 33-fold and an average cell diameter of 90 μm (Minicell L-200, produced by Hercules Co.) is sliced and evaluated according to the same method as in Example 7. Surface roughness, undulation are great, and also the cell structure is found to be greatly deformed after polishing.

COMPARATIVE EXAMPLE 8

By use of a commercially available polishing cloth made of polyurethane, polishing characteristics are evaluated. The polishing cloth has a structure having polyurethane expanded layers laminated on a polyester base cloth, with the polyurethane expanded layer having voids shaped in an eggplant shape with sizes of 100 to 200 μm in the thickness direction and the portion of 10 to 30 μm of the surface layer being a fine cell structure with cell diameter of about 30 μm, and the cell structure in the thickness direction is non-uniform, with the surface being greater in unevenness which may be considered to be due to the influence by the base cloth. The polishing cloth being so characterized is inferior in smoothness and is also inferior in chemical resistance. This is illustrated from the results of the evaluation of the polishing performance according to the same method as in Example 7, which show the polishing characteristics to be remarkably inferior in surface roughness, and the polishing characteristics to be so inferior to the extent that the poor quality of the wafer surface could be discernible by observation with the eyes.

TABLE 1

| | Properties of expanded product | | | | Polishing characteristics | | |
|---|---|---|---|---|---|---|---|
| | Expansion ratio | Average cell diameter (μm) | Size, ratio of unexpanded phase | | Chemical resistance | Polishing speed (μm/hr) | Quality of polished surface |
| Example 1 | 15 | 10 | 0.5 μm | 0.01% | Good | 3.2 | Extremely good |
| Example 2 | 2 | 3 | 23 | 40 | " | 4.8 | Good |
| Example 3 | 1.5 | 3 | 45 | 70 | " | 7.2 | Good |
| Example 4 | 8 | 40 | 0.5 | 0.08 | " | 20 | Extremely good |
| Example 5 | 8 | 60 | 40 | 0.5 | " | 3.8 | Good |
| Example 6 | 5 | 90 | 45 | 1 | " | 3.6 | Good |
| Comparative example 1 | 1.3 | 3 | 45 | 80 | " | 7.5 | Many Scratches |
| Comparative example 2 | 32 | 18 | 0.5 | 0.01 | " | 1.2 | Good |
| Comparative example 3 | 9 | 330 | 40 | 0.05 | " | 3.8 | Many scratches |
| Comparative example 4 | 1.5 | 36 | 45 | 72 | " | 3.0 | Many scratches |
| Comparative example 5 | 1.6 | 36 | 150 | 50 | " | 2.0 | Many Scratches |

TABLE 2

| | | | Characteristics of expanded product | | | Polishing characteristics | | | | |
|---|---|---|---|---|---|---|---|---|---|---|
| | Resin | Cross-linking | Expansion ratio (μm) | Average cell diameter | Surface smoothness (μm) | Chemical resitance | Surface roughness (Å) | Undulation appearance (Å) | Surface appearance | Appearance of polishing cloth after polishing |
| Example 7 | Polypropylene | None | 8 | 35 | 20 | Good | 10 | 90 | Excellent | No change |
| Example 8 | 4-methyl-1-pentene resin | None | 15 | 10 | 20 | Good | 10 | 100 | Good | No change |
| Example 9 | Polyethylene | " | 20 | 120 | 30 | Good | 60 | 110 | Good | Cell structure slightly changed |
| Example 10 | Ionomer | " | 28 | 90 | 35 | Good | 40 | 110 | Good | Cell structure slightly changed |
| Example 11 | Polypropylene | None | 4 | 33 | 20 | Good | 10 | 95 | Excellent | No change |
| Example 12 | Polyethylene | None | 8 | 1 | 20 | Good | 10 | 100 | Good | No change |
| Example 13 | Polyethylene | " | 8 | 90 | 25 | Good | 40 | 90 | Good | No change |
| Comparative example 6 | Polyethylene | None | 8 | 400 | 40 | Good | 100 | 200 | Bad | No change |
| Comparative example 7 | Polyethylene | " | 33 | 90 | 30 | Good | 100 | 200 | Bad | Cell structure greatly changed |
| Comparative example 8 | Polyurethane | " | 3 | 30 | 90 | Bad | 300 | — | Bad | Cell membrane broken |

We claim:

1. A polishing cloth comprising an expanded thermoplastic resin product having a cellular structure, and an expansion ratio of 1.5-fold to 30-fold, with substantially uniform cells having an average cell diameter of 300 μm or less being distributed within the cross-section of the expanded product, and with unexpanded resin phases of 0.5 μm to 45 μm surrounded by three or more cells, wherein the proportion of the unexpanded phases are 0.01% to 70% in terms of area ratio within the expanded product cross-section.

2. The polishing cloth according to claim 1, wherein the expansion ratio is 1.5-fold to 15-fold, and the average cell size is 1 μm to 90 μm.

3. The polishing cloth according to claim 1, having a cellular structure, and an expansion ratio of 1.5-fold to 15-fold, with an average cell diameter of 1 μm to 90 μm, and with unexpanded resin phases of 0.5 μm to 45 μm surrounded by three or more cells, wherein the proportion of the unexpanded phases are 0.01% to 10% in terms of area ratio within the expanded product cross-section.

4. The polishing cloth according to claim 1, wherein the cross-sections of the cells are exposed on at least one surface of the expanded thermoplastic resin product.

5. The polishing cloth according to claim 1, wherein the cross-sections of the cells are exposed on at least one surface of the expanded thermoplastic resin product and the undulations of the outermost surface of the exposed surface are 50 μm or less.

6. The polishing cloth according to claim 1, wherein at least one surface of the expanded thermoplastic resin product has grooves of a width of 0.1 to 2 mm, a depth of 0.1 to 2 mm formed regularly at intervals of 1 to 50 mm in a shape of lattice, diaper or satin thereon.

7. The polishing cloth according to claim 1, wherein cross-sections of cells are exposed on at least one surface of the expanded product of the thermoplastic resin and the exposed surface has grooves of a width of 0.1 to 2 mm, a depth of 0.1 to 2 mm formed regularly at intervals of 1 to 50 mm in a lattice, a diaper or a satin pattern.

8. The polishing cloth according to claims 1, 2, 3, 4, 5, 6 or 7, in which the cells are substantially uniform in size and shape, and wherein there are no abnormally shaped cells or voids comprised within the cross-sections of the expanded thermoplastic resin product.

9. The polishing cloth according to claim 8, wherein the abnormally shaped cells are cylinder or pear shaped and the voids are macrovoids which are greater by 3-fold or more than the average cell size.

10. The polishing cloth according to claims 1, 2, 3, 4, 5, 6 or 7, wherein the expanded thermoplastic resin product comprises a polyolefin or a fluoro-resin as the main component.

11. The polishing cloth according to claim 8, wherein the expanded thermoplastic resin product comprises a polyolefin or a fluoro-resin as the main component.

12. The poishing cloth according to claims 1, 2, 3, 4, 5, 6 or 7, wherein the expanded thermoplastic resin product comprises a polyolefin or a fluoro-resin as the main component and has a crosslinked structure.

13. A polishing cloth according to claim 8, wherein the expanded thermoplastic resin product comprises a polyolefin or a fluoro-resin as the main component and has a crosslinked structure.

14. The polishing method, which comprises mirror polishing a material to be worked by moving the polishing cloth according to any one of claims 1 to 7 relative to the material to be worked while supplying a polishing liquid onto the surface of the polishing cloth.

15. The polishing method according to claim 14, wherein the polishing liquid is an inorganic or organic liquid having the capability of converting the material to be worked to a compound which will readily dissolve or be liberated through dissolution or reaction.

16. The polishing method according to claim 14, wherein the surface of the material to be worked is mirror polished to a surface roughness of 100Å or less.

17. A polishing method, which comprises mirror polishing a material to be worked by moving a polishing cloth comprising an expanded thermoplastic resin product having a cellular structure and an expansion ratio of 1.5-fold to 30-fold, with substantially uniform cells having an average cell diameter of 300 μm or less being distributed within the cross-section of the expanded product, and with unexpanded phases of 0.5 μm to 45 μm surrounded by three or more cells, wherein the proportion of the unexpanded phases are 0.01% to 70% in terms of area ratio within the expanded product cross-section, relative to the material to be worked while supplying a polishing liquid onto the surface of the polishing cloth.

* * * * *